US007013901B2

(12) United States Patent
Morris

(10) Patent No.: US 7,013,901 B2
(45) Date of Patent: Mar. 21, 2006

(54) SYSTEM FOR GROOMING HAIR

(76) Inventor: Wayne Morris, 409 8th St., Fort Pierce, FL (US) 34950

( * ) Notice: Subject to any disclaimer, the term of this patent is extended or adjusted under 35 U.S.C. 154(b) by 120 days.

(21) Appl. No.: 10/815,323

(22) Filed: Apr. 1, 2004

(65) Prior Publication Data

US 2005/0217690 A1 Oct. 6, 2005

(51) Int. Cl.
*A45D 44/18* (2006.01)

(52) U.S. Cl. ..... 132/313; 401/126; 401/129

(58) Field of Classification Search ..... 132/131, 132/290, 108; 401/123–126, 129; 206/209, 206/209.1, 210; 15/184, 104.94, 257.01, 15/257.05

See application file for complete search history.

(56) References Cited

U.S. PATENT DOCUMENTS

| | | | | | |
|---|---|---|---|---|---|
| 70,194 | A | | 10/1867 | George | |
| 129,564 | A | * | 7/1872 | Hovey | 132/103 |
| 1,194,540 | A | * | 8/1916 | Quartararo | 206/209.1 |
| 3,620,229 | A | * | 11/1971 | Friedman | 132/119 |
| 4,013,086 | A | * | 3/1977 | Chmela | 132/110 |
| 4,289,153 | A | | 9/1981 | Paccione | |
| 4,585,018 | A | * | 4/1986 | O'Connor | 132/120 |
| 4,628,564 | A | | 12/1986 | Youssef | |
| 5,188,472 | A | | 2/1993 | Sgro | |
| 5,291,905 | A | * | 3/1994 | Busch et al. | 132/116 |
| 5,325,878 | A | * | 7/1994 | McKay | 132/116 |
| 5,783,249 | A | | 7/1998 | Sanduja et al. | |
| 6,062,757 | A | | 5/2000 | Gueret | |
| 6,158,442 | A | * | 12/2000 | Piatetsky | 132/115 |
| 6,213,129 | B1 | | 4/2001 | Muldoon | |

* cited by examiner

*Primary Examiner*—Todd E. Manahan
*Assistant Examiner*—Rachel A. Running
(74) *Attorney, Agent, or Firm*—M. K. Silverman

(57) ABSTRACT

A kit for the grooming of hair includes a lower shell having a flat lower surface, the lower shell having an upper peripheral edge, an interior cavity of the shell provided with a selectably replaceable absorptive pad substantially filling a base of the interior cavity. The kit also includes an upper shell having a flat upper surface and a lower peripheral edge, the edge proportioned for selectable engagement with the upper peripheral edge of the lower shell. The kit further includes a multiplicity of brush bristles, each having one end embedded within a base of an internal cavity of the upper shell, the bristles having a length sufficient to project into the absorptive paid when the lower edge of the upper shell is secured to an upper edge of the lower shell. The flat upper surface of the upper shell may include a surface defined by a peripheral edge proportioned for selectable engagement within the upper peripheral edge of the lower shell.

4 Claims, 2 Drawing Sheets

SYSTEM FOR GROOMING HAIR

BACKGROUND OF THE INVENTION (a) Area of the Invention

The present invention relates to systems for hair grooming.

(b) Prior Art

The present invention relates to a hair grooming system in the nature of a kit in which a solid or viscous material to be employed in the hair grooming process is provided within an absorptive pad which is part of the kit.

Efforts in the prior art to integrate absorptive material into a brush or the like which, in turn, would be provided with an oil or other grooming material are rare in the and, to the knowledge of the inventor, only appear in U.S. Pat. No. 70,194 (1867) to George and et al, entitled Hair Brush; U.S. Pat. No. 4,289,153 (1981) to Paccione, entitled Hair Styling Device; and U.S. Pat. No. 6,213,129 (2001) to Muldoon, entitled Cradle Cap Kit.

The above reference to George, et al relates to a sponge, layers of cotton, or the like which are embedded within a brush for the purpose of controlling the movement and retention of oil or other grooming material which a user may wish to employ during the use of the brush. Therein, no means exists to assure the retention of the sponge or absorbent material in a manner convenient to long term usage and which would minimize evaporation of the oil or other material from the sponge.

The above reference to Paccione is essentially a hair styling device which contains therein chambers for the storage of two different types of liquid which may be selectably discharged during the hair styling process. The present invention does not address a system for use by professional hair stylists, nor does it provides means for the mechanical dispensing of liquid or viscous material during the hair styling process.

The reference to Muldoon contains many similarities to that of Paccione and, further, is limited in its application to infants and the problems of the scalp of infants known as cradle cap. The present invention has no such pediatric application.

Mascara kits are known that include a supply of the mascara material to assure that the mascara brush is constantly provided with sufficient material to provide a "wet look" when the same is applied to the eyelashes, this as is reflected in U.S. Pat. No. 6,062,757 (2000) to Gueret, entitled Portable Packaging Unit For A Product Such As Mascara.

Toothbrushes have been suggested which are provided with an internal supply of tooth cleaning liquid or paste, as is reflected in U.S. Pat. No. 4,628,564 (1986) to Youssef and U.S. Pat. No. 5,783,249 (1998) to Sanduja, et al.

Further, the prior art includes shoe polish kits in which the bristles of a brush kit may contact shoe polish within a base portion of the kit, as is reflected in U.S. Pat. No. 5,188,472 (1993) to Sgro, entitled Shoe Polish Application Kit. The present invention applies to certain of the principles of Sgro to provide an improved hair grooming kit in which an absorptive pad thereof may be selectably replaced to change or replenish the grooming substance which the user desires to employ in association with a brush portion of the kit.

SUMMARY OF THE INVENTION

The present invention relates to a kit for the grooming of hair, the kit comprising a lower shell having a flat lower surface, said lower shell having an upper peripheral edge, an interior cavity of said shell provided with a selectably replaceable absorptive pad substantially filling a base of said interior cavity. The kit also includes an upper shell having a flat upper surface and a lower peripheral edge, said edge proportioned for selectable engagement with said upper peripheral edge of said lower shell. The kit further includes a multiplicity of brush bristles, each having one end thereof embedded within a base of an internal cavity of said upper shell, said bristles having a length sufficient to project into said absorptive paid when said lower edge of said upper shell is secured to an upper edge of said lower shell. Said flat upper surface of said upper shell may comprise a surface defined by a peripheral edge proportioned for selectable engagement within said upper peripheral edge of said lower shell.

It is accordingly an object of the invention to provide a kit for the grooming of hair which includes a self-contained source of a grooming liquid or viscous material to be used as a part of the grooming process.

It is another object to provide a kit of the above type having particular utility for travel purposes or within a lady's handbag or purse.

It is a further object of the invention to provide a kit of the above type in which the glooming liquid or product to be applied to the hair may be readily changed by selectable replacement of an absorptive pad provided with a grooming substance or product.

It is a yet further object to provide a kit of the above type which may be converted from a carrying or storage mode to a use mode thereof.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
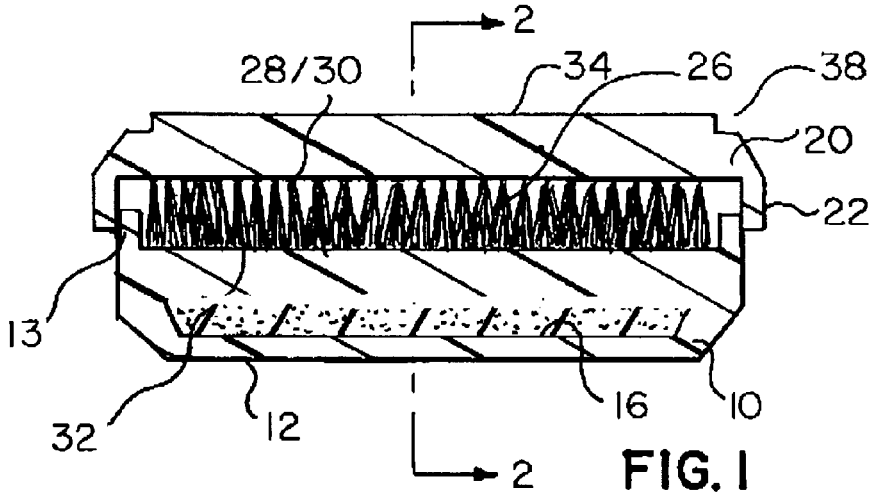
FIG. 1 is a front cross-sectional view of the inventive kit wherein the upper shell thereof is secured to the lower shell of the system.
Figure 3:
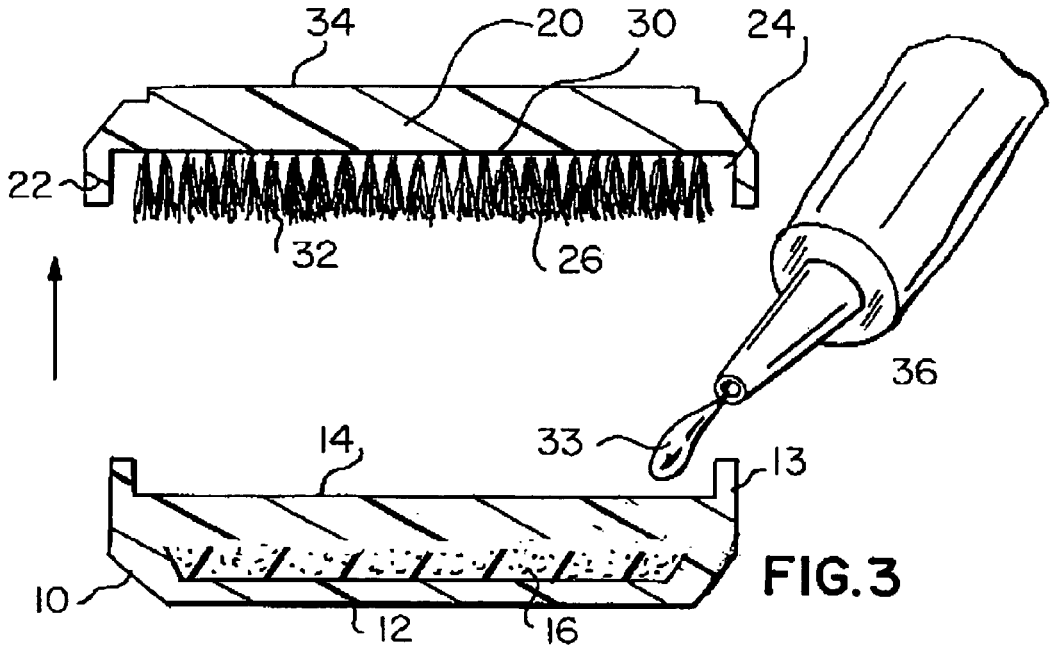
FIG. 3 is an exploded view of FIG. 1 further showing the manner in which a grooming liquid may be added to the adsorptive pad of the kit.
Figure 2:
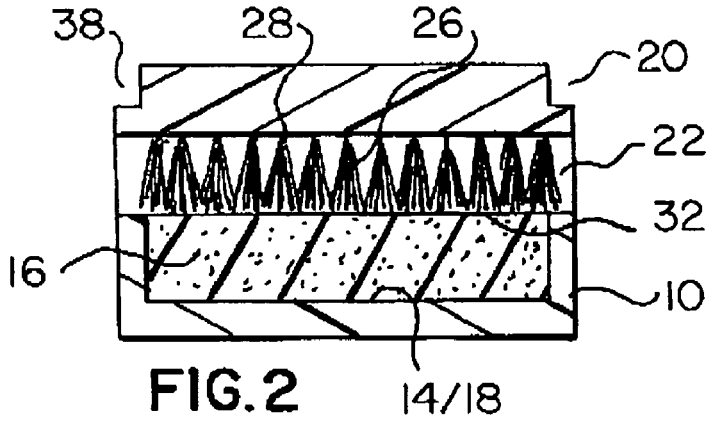
FIG. 2 is a cross-sectional view taken along Line 2—2 of FIG. 1.

With reference to the views of FIGS. 1, 2 and 3, the inventive kit for the grooming of hair may be seen to include a lower shell 10 having a flat lower surface 12, upper peripheral edge 13 and interior cavity 14. The lower shell is provided with a selectably replaceable absorptive pad 16 which substantially fills a base 18 of said interior cavity 14.

As may be further noted, the kit also includes an upper shell 20 having a lower peripheral edge 22 which is proportioned for snap-fittable engagement about said upper peripheral edge 13 of said lower shell 10.

Secured within an internal cavity 24 of said upper shell 20 is a multiplicity of brushes 26, each having one end 28 thereof embedded within a base 30 of said internal cavity 24 of said upper shell 20. As may be noted, said bristles are provided with a length sufficient to enable them to project into absorptive pad 16 (see FIGS. 1 and 2) when said peripheral edge 22 of upper shell 20 is secured to said upper peripheral edge 13 of said lower shell 10. Accordingly, where absorptive pad 16 is formed of a material such as sponge or the like, a significant amount of liquid or other viscous substance or nutritional product may be applied and retained therein. When the present kit is closed to form a case (see FIG. 1) distal ends 32 of the bristles 26 will project into pad 16 and thereby will cover the material which has been stored within pad 16.

In FIG. 3 is shown one manner in which pad 16 may be filled by a liquid 33 dispensed from a bottle 36. Alternatively, it is to be appreciated that pad 16 which has been pre-filled or pre-impregnated with the liquid or viscous product of interest may be furnished in a sealed pouch or the like and then selectively opened, on an as needed basis, for insertion within recess 14 of lower shell 10.

Figure 4:
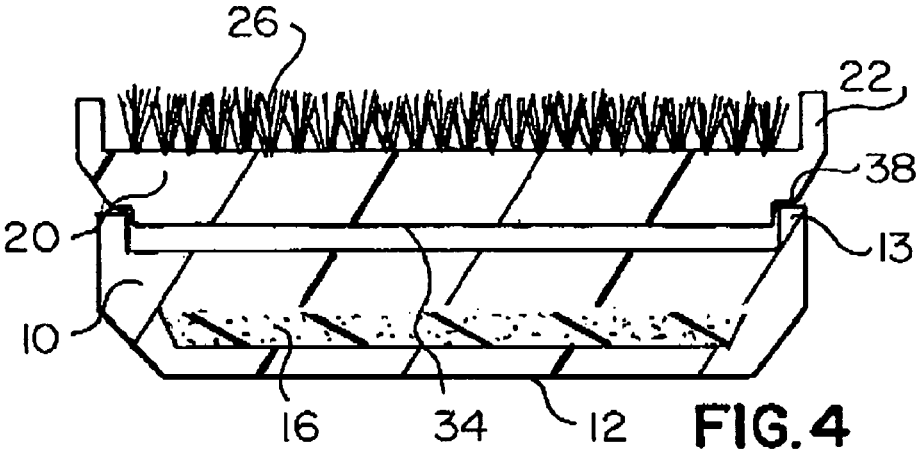
FIG. 4 is a front cross-sectional view showing the inversion of the upper shell and the securement of a flat upper surface thereof of within a peripheral edge of the lower shell to form a handle by which the upper shell may be secured to thereby form an operational brush.

In FIG. 4 is shown an embodiment of the invention in which upper surface 34 has been provided with a peripheral edge 38 which is complemental to upper peripheral edge 13 of lower shell 10. As such, when the upper shell is inverted (as is shown in FIG. 4) upper surface 34 of upper shell 20 may be press-fittably secured within upper peripheral edge 13 of lower shell 10.

It is, as well, to be appreciated that, in lieu of the use of press-fittable peripheral edges, such as edges 13, 22 and 38, the present kit may be formed of circular upper and lower shells such that the securement in the closed position shown in FIGS. 2 and 3 and the securement in the use position of FIG. 4, may be accomplished through the use of complementally threadable lateral peripheral edges.

Figure 5:
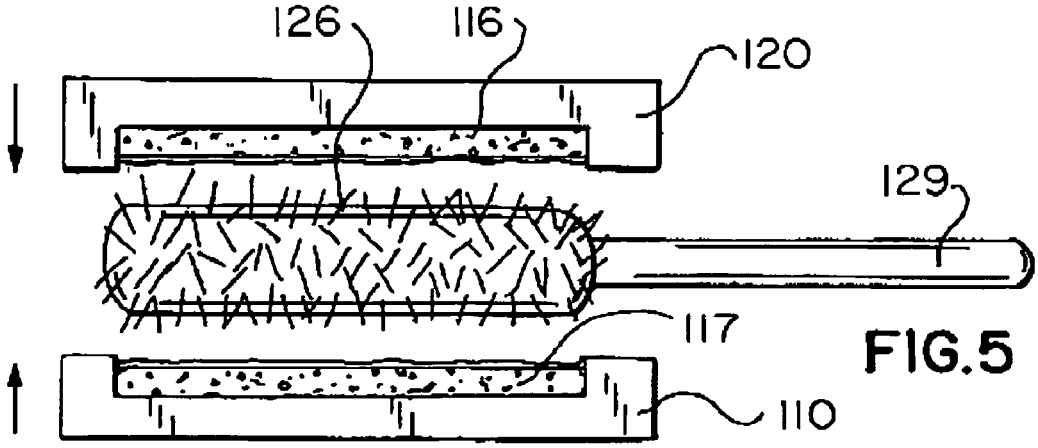
FIG. 5 is an exploded view of a further embodiment of the invention in which hollow partial cylindrical shells surround a substantially elongate cylindrical brush.

In FIG. 5 is shown a further embodiment of the invention in which the shells are more elongate, or in a given embodiment may comprise a hemisphere of a hollow cylinder, while the upper shell of the embodiments of FIGS. 1–4 takes the form of an elongate hollow cylinder in which appropriate surfaces for press-fittable connection between the two are provided. In this embodiment, separate pads 116 and 117 are provided within the respective upper and lower shells 120 and 110, this so that bristles 126 of brush 129 may be maintained with the desired liquid or viscous material in the fashion above-described with respect to the embodiment of FIGS. 1–4.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. A kit for grooming hair, comprising:

(a) a lower shell having a flat lower surface, said lower shell having an upper peripheral edge, an interior cavity of said shell provided with a selectable replaceable absorptive pad substantially filling a base of said interior cavity;

(b) an upper shell having a flat upper surface and a lower peripheral edge, said edge proportioned for snap-fittable engagement about said upper peripheral edge of said lower shell; and (c) a multiplicity of brush bristles, each having one end thereof secured within a base of an internal cavity of said upper shell, said bristle having a length sufficient to project into said absorptive pad when said peripheral edge of said upper shell is secured to said upper peripheral edge of said lower shell.

2. The kit as recited in claim 1, in which said flat upper surface of said upper shell comprises a surface defined by a peripheral edge proportioned for snap-fittable engagement within said upper peripheral edge of said lower shell.

3. The kit as recited in claim 1, in which said flat upper surface of said upper shell comprises a surface defined by a circular peripheral edge proportioned for threadable engagement within said upper peripheral edge of said lower shell.

4. A kit for grooming hair, comprising:

(a) a lower shell having a flat lower surface, said lower shell having a threaded upper peripheral edge, an interior cavity of said shell provided with a selectable replaceable absorptive pad substantially filling a base of said interior cavity;

(b) an upper shell having a flat upper surface and a threaded lower peripheral edge, said edge proportioned for threadable engagement about said upper peripheral edge of said lower shell; and (c) a multiplicity of brush bristles, each having one end thereof embedded within a base of an internal cavity of said upper shell, said bristle having a length sufficient to project into said absorptive pad when said peripheral edge of said upper shell is secured to said upper peripheral edge of said lower shell.

* * * * *